US006689945B1

(12) United States Patent
Matsuzoe et al.

(10) Patent No.: US 6,689,945 B1
(45) Date of Patent: Feb. 10, 2004

(54) FOOT PEDAL FOR DRUM

(75) Inventors: Takashi Matsuzoe, Tokyo (JP); Nobumoto Maehara, Tokyo (JP); Akio Kawada, Chiba (JP)

(73) Assignee: MK Corporation, Tokyo (JP)

( * ) Notice: Subject to any disclaimer, the term of this patent is extended or adjusted under 35 U.S.C. 154(b) by 0 days.

(21) Appl. No.: 10/319,609

(22) Filed: Dec. 16, 2002

(30) Foreign Application Priority Data

Jul. 30, 2002 (JP) ..... 2002-221246

(51) Int. Cl.[7] ..... G10D 13/02

(52) U.S. Cl. ..... 84/422.1; 84/422.2; 84/422.3

(58) Field of Search ..... 84/422.1, 422.2, 84/422.3

(56) References Cited

U.S. PATENT DOCUMENTS 6,011,208 A * 1/2000 Hoshino ..... 84/422.1
6,359,205 B1 * 3/2002 Lombardi ..... 84/422.1

* cited by examiner

*Primary Examiner*—Kimberly Lockett
(74) *Attorney, Agent, or Firm*—Birch, Stewart, Kolasch & Birch, LLP

(57) ABSTRACT

A foot pedal for a drum which beats a drum head by swinging a beater according to pressing of a pedal is provided with a heel which pivotally supports the pedal along a pressing direction of the pedal, and a base plate which has an arc-shaped groove allowing pivoting of the heel on a horizontal plane, wherein the pedal and the heel are pivotable integrally along the guide groove, and the heel can be fixed to the base plate at any position along the guide groove. Accordingly, the pedal can be set at an optimal angle or orientation for a player even in a state that the foot pedal remains fixed to a bass drum.

6 Claims, 11 Drawing Sheets

FOOT PEDAL FOR DRUM

This nonprovisional application claims priority under 35 U.S.C. §119(a) on Patent Application No. 2002-221246 filed in JAPAN on Jul. 30, 2002, which is herein incorporated by reference.

BACKGROUND OF THE INVENTION

1. Field of the Invention

The present invention relates to a foot pedal for beating the drum head of a bass drum by pressing the pedal itself.

2. Description of the Related Art

Conventionally, various foot pedals for a drum of such a kind have been proposed.

For example, FIGS. 7 to 11 show a foot pedal for a drum which has been described in JP08-146946A and whose structure will briefly be explained below.

This foot pedal for a drum has been proposed for the purpose of setting a bass drum or the foot pedal at an angle (orientation) at which a player can play the best.

That is, in FIGS. 7 and 8, reference numeral 100 denotes a generally U-shaped frame, reference numerals 101 and 102 denote struts, reference numeral 103 denotes a bottom plate, reference numeral 104 denotes a shaft supported between the struts 101, 102, reference numeral 105 denotes a rocker fixed to the shaft 104, reference numeral 106 denotes a beater mounted adjacent to the rocker 105, reference numeral 107 denotes a spring for imparting a returning force to the shaft 104, reference numeral 108 denotes a pressing force transmitting member, such as a chain, whose one end is fixed to an outer peripheral face of the rocker 105, reference numeral 109 denotes a pedal which is coupled to the other end of the pressing force transmitting member 108 and whose heel side is supported by a shaft 110, reference numeral 111 denotes a clamp metal fitting for fixing the whole foot pedal to a hoop of a bass drum, reference numeral 112 denotes a fixing screw for driving the clamp metal fitting 111, and reference numeral 113 denotes an anchor screw for preventing the whole footpedal from displacing on a floor face.

Also, as shown in detail in FIG. 8, reference numeral 200 denotes a coupling plate whose rear end portion is fixed to a heel 114 of the pedal 109 by a screw 201 and whose front end portion is screwed to the bottom plate 103 of the frame 100 by a screw 202.

Incidentally, reference numerals 203 and 204 denote creepers formed on a back face of the coupling plate 200.

In the conventional foot pedal constituted in the above manner, the frame 100 is rotatable about the screw 202 relative to the coupling plate 200.

Therefore, as shown in FIG. 9 and FIG. 10, in a state that the frame 100 has been fixed to the hoop 301 of the bass drum 300 by the clamp metal fitting 111, the coupling plate 200 can be rotated together with the pedal 109. Accordingly, for example, in case that the foot pedal is operated by the right foot of a player or a drummer, the pedal 109 can be set such that the heel 114 is directed inwardly in a state that a front face of the bass drum 300 is directed to an audience, as shown in FIG. 9. Even in this case, the beater 106 can beat the drum head along a direction perpendicular thereto.

Since the conventional foot pedal has such a structure, the foot pedal 109 or the bass drum 300 can be set in an optimal orientation for a player or a drummer.

Incidentally, FIG. 11 shows a structure for preventing the pressing force transmitting member 108 from being distorted.

In FIG. 11, reference numeral 115 denotes a fixing metal fitting which is mounted to one end portion of the pressing force transmitting member 108, reference numeral 116 denotes a bolt, reference numeral 117 denotes a rotary plate, reference numeral 118 denotes a screw hole formed at one end portion of the pedal 109. The pressing force transmitting member 108 and the pedal 109 are coupled to each other by sandwiching the fixing metal fitting 115 and the rotary plate 117 between the bolt 116 and the pedal 109 to screw the bolt 116 into the screw hole 118.

According to this structure, since the pedal 109 is allowed to rotate relative to the pressing force transmitting member 108 slightly, consideration has been taken such that distortion does not occur in the pressing force transmitting member 108 even when the pedal 109 is set to the frame 100 at such a position that the former has been rotated relative to the latter, as shown in FIG. 9 or FIG. 10, According to the above-described conventional art, it is possible to set the pedal 109 at a desired angle (orientation) securely, but there are the following problems.

First of all, it is assumed that the frame 100 is rotated relative to the coupling plate 200 by a desired angle, and the whole foot pedal is fixed to the hoop 301 of the bass drum 300 by the clamp metal fitting 111 according to fastening of the screw 202. In this state, when a player is not satisfied with the angle (orientation) of the pedal 109 and he/she wishes to adjust it finely, it is necessary to loosen the screw 202, acting as a rotation center axis, which rotatably supports the frame 100 to the coupling plate 200.

However, in order to loosen the screw 202 while the frame 100 remains fixed to the hoop 301, it is necessary to lift this side (player side) of the bass drum 300 slightly to loosen the screw 202 from the underside of the coupling plate 200 (a floor face side) by a screw driver or the like, which requires an extremely complicated and troublesome work.

Also, when such means is not taken, a procedure including steps of loosening the screw 202, adjusting a relative rotational angle between the frame 100 and the coupling plate 200, and thereafter fixing the whole foot pedal to the hoop 301 by the clamp metal fitting 111 after the screw 202 is fastened again must be employed in a state that the whole foot pedal has been detached from the hoop 301 by releasing clamping conducted by the clamp metal fitting 111.

Even in either case, conventionally, the angle (orientation) setting work for the pedal 109 is extremely complicated and difficult to conduct, and the foot pedal for a drum is inconvenient in use.

In view of the above problem, an object of the present invention is to provide a foot pedal for a drum which facilitates a setting work of an angle for a pedal and where convenience in use has been improved by performing various improvements.

SUMMARY OF THE INVENTION

In order to solve the above problem, according to a first aspect of the present invention, there is provided a foot pedal for a drum which beats a drum head by swinging a beater according to pressing of a pedal, comprising a heel which pivotally supports the pedal along a pressing direction of the pedal; and a base plate which has an arc-shaped guide groove allowing pivoting of the heel on a horizontal plane, wherein the pedal and the heel are pivotable integrally along the guide groove, and the heel can be fixed to the base plate at any position along the guide groove.

According to a second aspect of the invention, there is provided a foot pedal for a drum according to the first aspect, further comprising: a frame which is provided in a standing manner and fixed on a top face of the base plate; a shaft which is bridged between a pair of struts of the frame and to which a beater is fixed; a pressing force transmitting member which transmits a pressing of the pedal to the shaft to rotate the shaft and swing the beater; an angle adjusting member which is connected to an end of the pressing force transmitting member which is positioned on a side opposed to the shaft to pivotably support the pedal at a distal end portion thereof; a fixing screw for fixing the pedal to the angle adjusting member from the above; and another fixing screw for fixing the heel to the base plate from the above.

According to a third aspect of the invention, there is provided a foot pedal for a drum according to the second aspect, wherein the angle adjusting member has at least one angle adjusting face which comes in plane contact with an end face of the pedal to position the pedal.

According to a fourth aspect of the invention, there is provided a foot pedal for a drum according to any one of the first to third aspects, wherein the heel is formed so as to be movable on the base plate in a direction generally perpendicular to the guide groove. With this constitution, the heel and the pedal can be moved in forward and rearward directions of a foot of a player.

As described above, according to the invention, the angle (orientation) of the pedal can be set as a player wishes in a state that the foot pedal remains fixed to the bass drum. Also, setting of the pedal can be performed by only operation of the fixing screws and positioning operation of the pedal. Therefore, such a complicated work is not required that the foot pedal is detached from the bass drum or the screw is operated from the underside of the foot pedal, so that a foot pedal which is much convenient in use can be provided.

Further, since the foot pedal for a drum of the present invention can be manufactured by only improving an existing foot pedal for a drum slightly, the present invention can be realized at a low cost.

EMBODIMENT OF THE INVENTION

An embodiment of the present invention will be explained with reference to the drawings.

Figure 1:
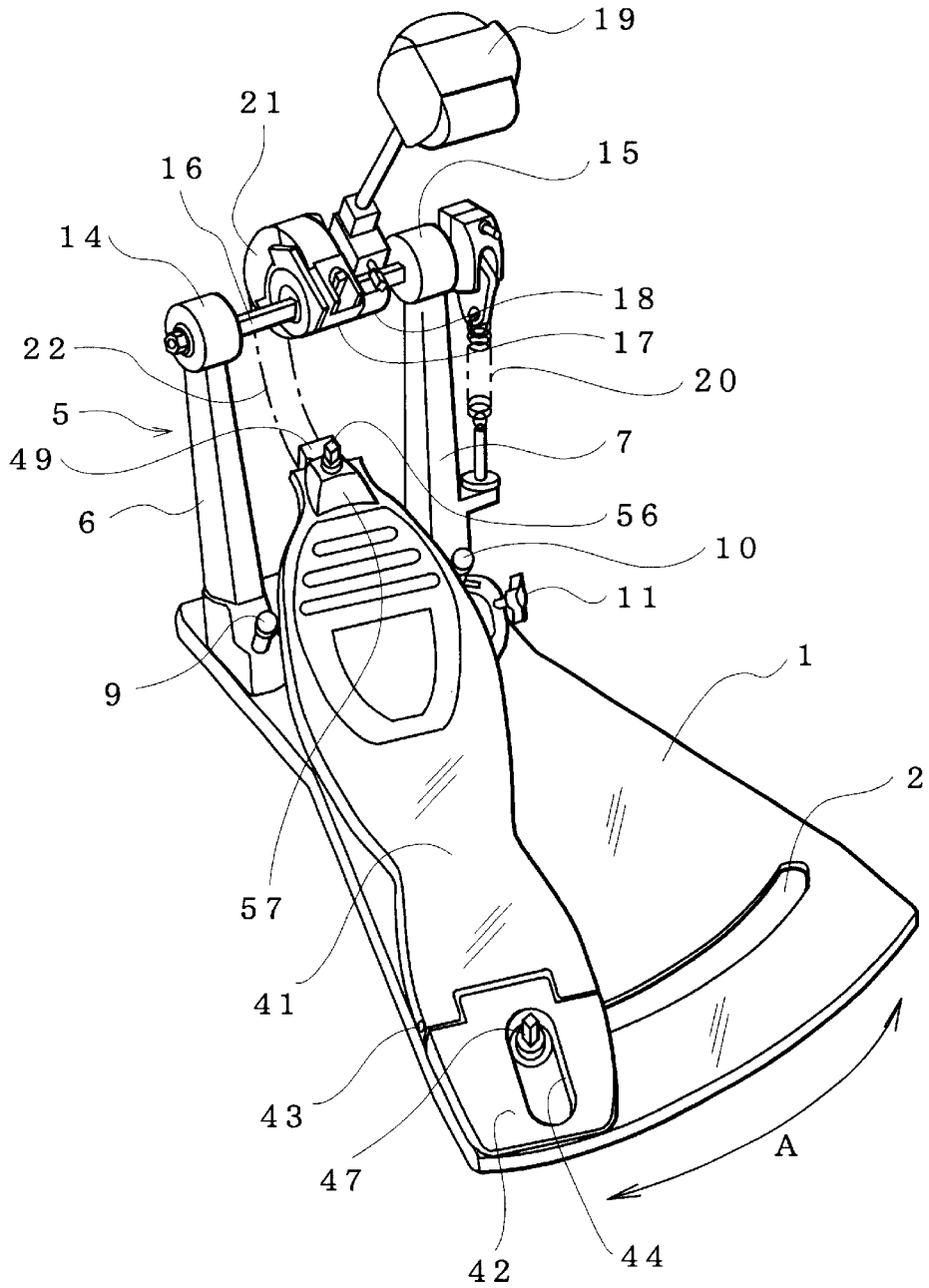
FIG. 1 is a perspective view showing an embodiment of the present invention.
Figure 2:
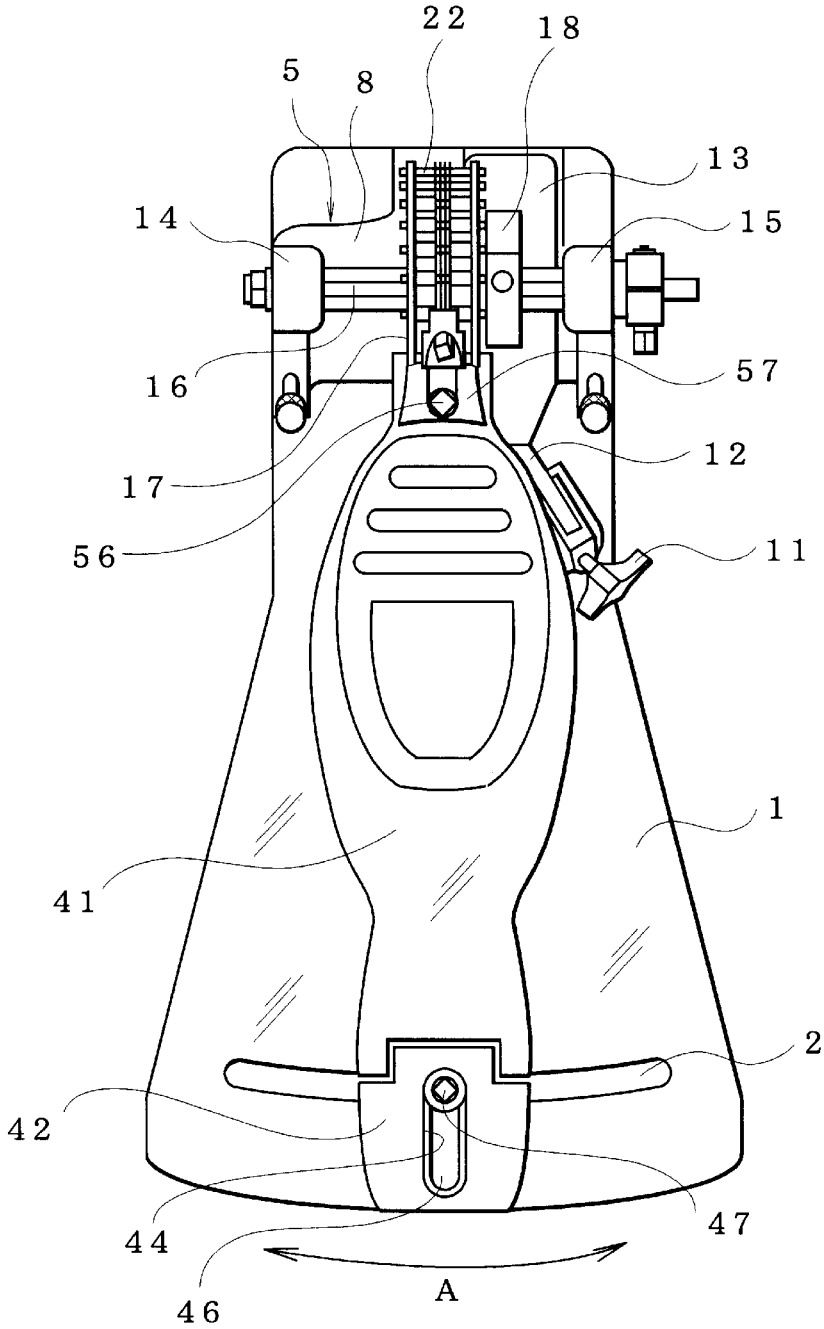
FIG. 2 is a top view showing the embodiment of the present invention.
Figure 3:
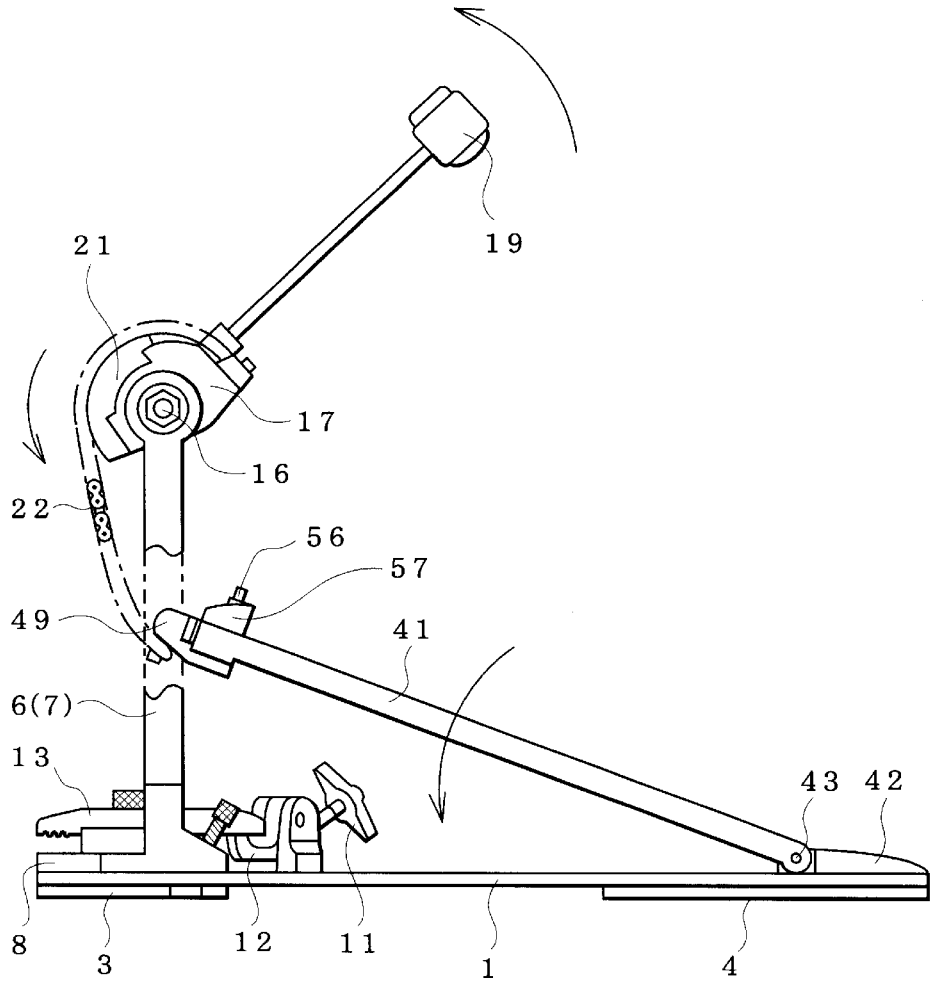
FIG. 3 is a side view showing the embodiment of the present invention.

First of all, FIG. 1 is a perspective view of a foot pedal for a drum of an embodiment, FIG. 2 is a top view thereof (where a beater has been detached for convenience), and FIG. 3 is a side view thereof.

In these figures, reference numeral 1 denotes a flat base plate formed in a fan shape or a foot fin shape, which is formed at its rear wider portion with an arc-shaped guide groove 2. As shown in FIG. 3, rubber plates 3 and 4 for preventing slippage are respectively attached on a front portion and a rear portion on a back face of the base plate 1.

A generally U-shaped frame 5 as viewed from its front is provided in a standing manner on a front end portion of a surface of the base plate 1, and this frame 5 has a pair of struts 6 and 7, and a bottom plate 8 (refer to FIG. 2). Incidentally, anchor screws 9 and 10 are respectively disposed on proximal ends of the struts 6 and 7. Distal ends of the anchor screws 9 and 10 are pierced in a floor by screwing these screws, so that the foot pedal is wholly prevented from displacing.

Also, reference numeral 11 denotes a fastening screw for a clamp metal fitting, reference numeral 12 denotes a lever, and reference numeral 13 denotes a clamp metal fitting. The whole foot pedal is fixed to the bass drum by fastening the fastening screw 11 to pivot a distal end portion of the lever upwardly and lower a distal end portion of the clamp metal fitting 13 to clamp a bass drum (not shown) between the clamp metal fitting 13 and the bottom plate 8.

Bearing portions 14 and 15 are respectively provided at upper end portions of the struts 6 and 7, and a shaft 16 are rotatably supported between the bearing portions 14 and 15. A rocker 17 is integrally fixed to the shaft 16, and a beater 19 is mounted to a beater fixing portion 18 adjacent to the rocker 17. Also, a spring 20 for applying a returning force to the shaft 16 is confined between one end portion of the shaft 16 and a proximal end portion of the strut 7.

A cam member 21 is fixed to an outer peripheral face of the rocker 17, and a pressing force transmitting member 22, such as a chain, a belt, a timing belt or the like, which couples the rocker 17 and the shaft 16 to a pedal 41 described later is mounted along an outer peripheral face of the cam member 21.

On one hand, reference numeral 41 denotes the pedal whose rear end portion is coupled to a heel 42 via a shaft 43 pivotably relative to the heel 42 along a pressing direction. Here, a mounting structure of the heel 42 to the base plate 1 will be explained with reference to FIG. 4.

Figure 4:
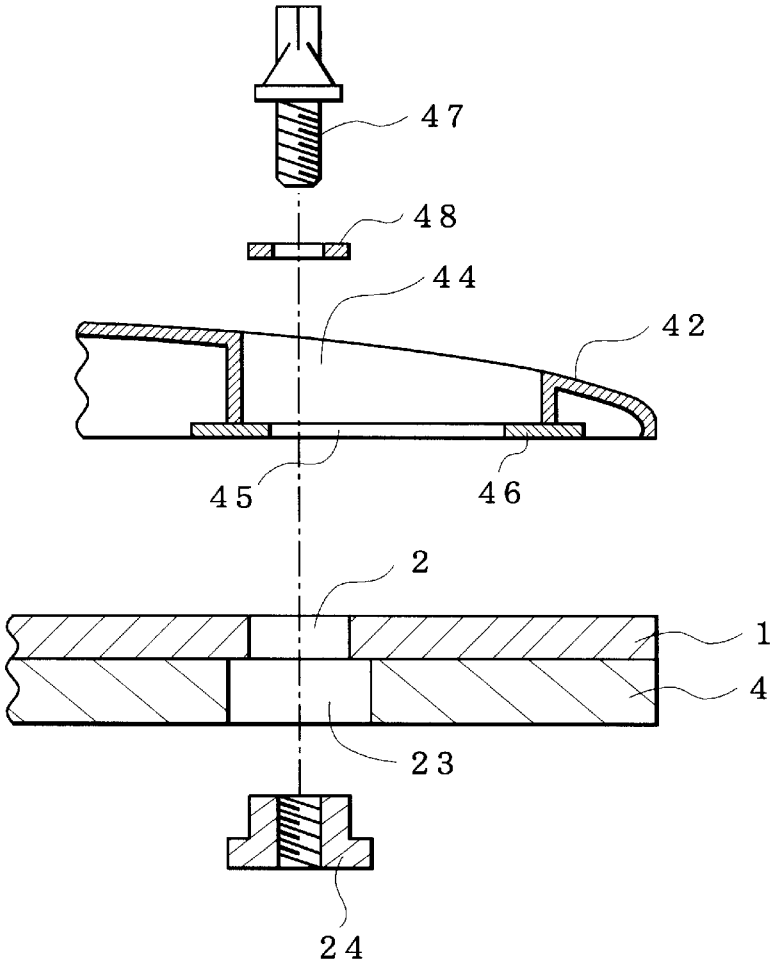
FIG. 4 is a view showing a mounting structure of a heel to a base plate in the embodiment of the present invention.

As shown in FIG. 4, an elongated hole 44 extending in a longitudinal direction of the heel (a direction generally perpendicular to the guide groove 2) is formed in the heel 42, and a receiving plate 46 formed with an elongated hole like the above is fixed to the heel 42 under the elongated hole 44. Also, reference numeral 47 denotes a fixing screw (a key bolt) for positioning and fixing the heel 42, which is inserted into the elongated holes 44 and 45 via a washer 48.

A guide groove 23 corresponding to the guide groove 2 of the base plate 1 is formed in the rubber plate 4 on the back face of the base plate 1, and a nut 24 movable along lengthwise directions of the guide grooves 2 and 23 can be received in these guide grooves 2 and 23. Incidentally, the nut 24 is formed in an elongated shape extending in a direction perpendicular to the plane of the drawing showing FIG. 4 such that the nut 24 is not rotated when the fixing screw 47 is screwed into the nut 24, and an outer peripheral face of the nut 24 can be engaged with inner faces of the guide grooves 2 and 23.

According to the structure shown in FIG. 4, the heel 42 is fixed to the base plate 1 by inserting the fixing screw 47 into the elongated hole 44 of the heel 42 and the elongated hole 45 of the receiving plate 46 via the washer 48 and fastening the fixing screw 47 to the nut 24 positioned on the side of the base plate 1.

Also, when the fixing screw 47 is loosened, the heel 42 is pivotally moved to any position on a pivoting path along the guide groove 2, as shown with arrow A in FIGS. 1 and 2. Therefore, the heel 42 is securely fixed to the base plate 1 and the pedal 41 is also positioned by fastening the fixing screw 47 to the nut 24 in a state that the heel 42 has been positioned at a desired position.

Further, in a state that the fixing screw 47 has been loosened, since the heel 42 and therefore the pedal 41 is movable in a stepless manner in front and rear directions (the longitudinal direction of the pedal 41), an inclination angle or a pressing area can be adjusted to an optimal value.

Next, the coupling structure of the pedal 41 and the pressing force transmitting member 22 will be explained with reference to FIGS. 3, 5A and 5B.

As shown in FIG. 3, the pressing force transmitting member 22 and the pedal 41 are coupled to each other via an angle adjusting member 49. The angle adjusting member 49 pivotably supports the pedal 41, as described below, so that it also functions as a member for preventing distortion of the pressing force transmitting member 22.

Figure 5A:
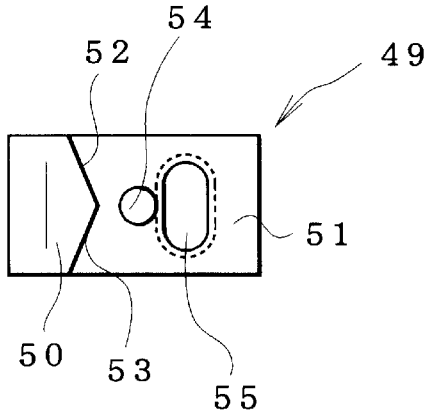
FIGS. 5A and 5B are explanatory views of an angle adjusting member and a coupling structure using the same in the embodiment of the present invention.

FIG. 5A is a top view of the angle adjusting member 49. The angle adjusting member 49 has a stepped portion 50 and a flat plate portion 51. The stepped portion 50 is provided with a pair of angle adjusting faces 52 and 53 facing the flat plate portion, and the flat plate portion 51 has a dowel 54 and an elongated hole 55 which is a stepped hole.

Figure 5B:
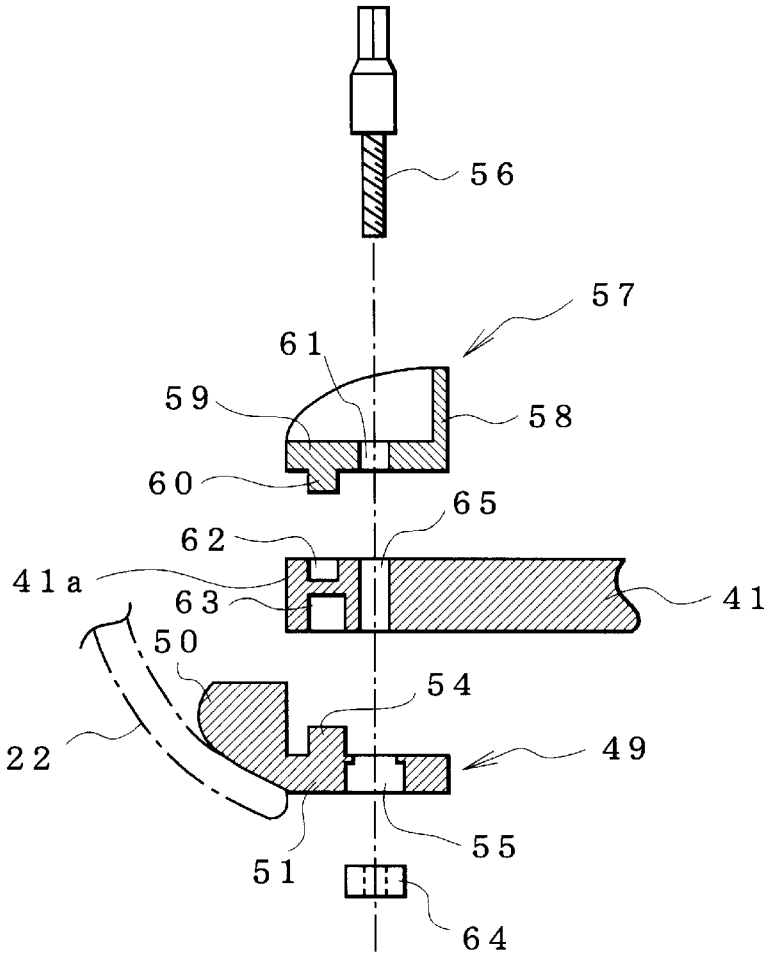

FIG. 5B is an exploded view of the coupling structure using the angle adjusting member 49. In the figure, reference numeral 56 denotes a fixing screw (a key bolt), and reference numeral 57 denotes a stopper disposed at a distal end portion of the pedal 41. The stopper 57 has a wall plate 58 on which a toe of a player abuts and a bottom plate 59, and the bottom plate 59 is provided with a dowel 60 projecting from a back face thereof and a through hole 61.

Also, the pedal 41 is provided at its distal end portion with a through hole 65, a blind hole 62 fitted with the dowel 60 and a blind hole 63 fitted with the dowel 54 of the angle adjusting member 49. Here, reference numeral 41*a* denotes an end face abutting on the angle adjusting faces 52 and 53 of the angle adjusting member 49.

Incidentally, as shown in FIG. 5B, reference numeral 64 denotes a nut which is fastened to the fixing screw 56 and is received in the elongated hole 55 to be movable slightly. The nut 64 is formed in an elongated shape extending in a direction perpendicular to the plane of the drawing showing FIG. 5B such that it is not rotated together with the fixing screw 56, and an outer peripheral face of the nut 64 can be engaged with an inner face of the elongated hole 55.

With the above-described structure, the pedal 41, the stopper 57 and the angle adjusting member 49 are fixed integrally by screwing the fixing screw 56 into the nut 64 in a state that the stopper 57 and the angle adjusting member 49 have been attached to an upper face and a back face of the pedal 41, so that the pressing force transmitting member 22 and the pedal 49 are coupled to each other.

At this time, as described above, since a portion of the pedal 41 positioned on the side of the heel 42 is pivotally movable along the guide groove 2, the distal end portion of the pedal 41 is rotated about the dowel 54 of the angle adjusting member 49. At this time, since the distal end portion of the pedal 41 is coupled to the angle adjusting member 49 by the nut 64 and the fixing screw 56 movable within the elongated hole 55 of the angle adjusting member 49, the pedal 41 can be pivoted or rotated with a slight play in a state that it remains coupled to the angle adjusting member 49.

Figure 6:
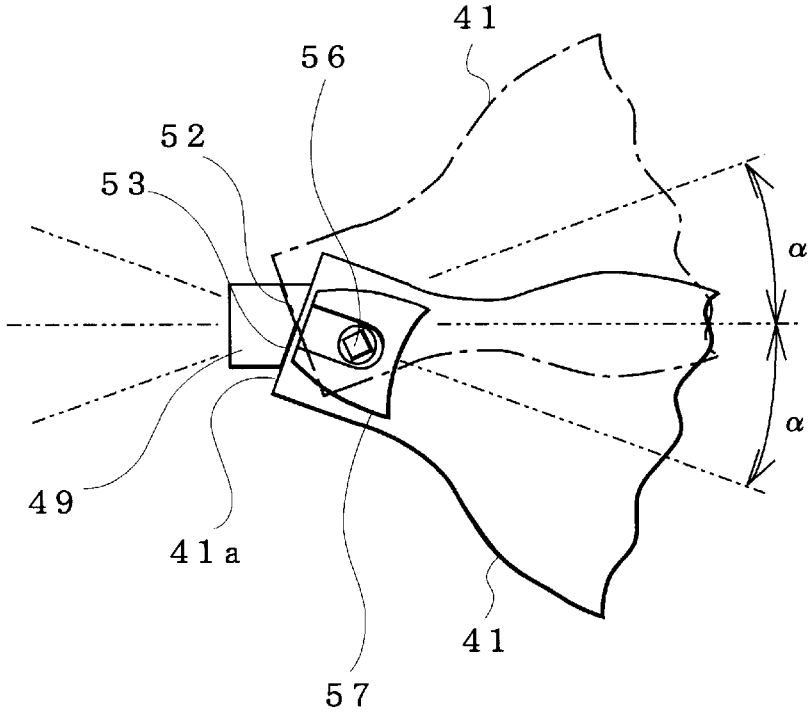
FIG. 6 is an explanatory diagram showing operation in the embodiment of the present invention.
Figure 7:
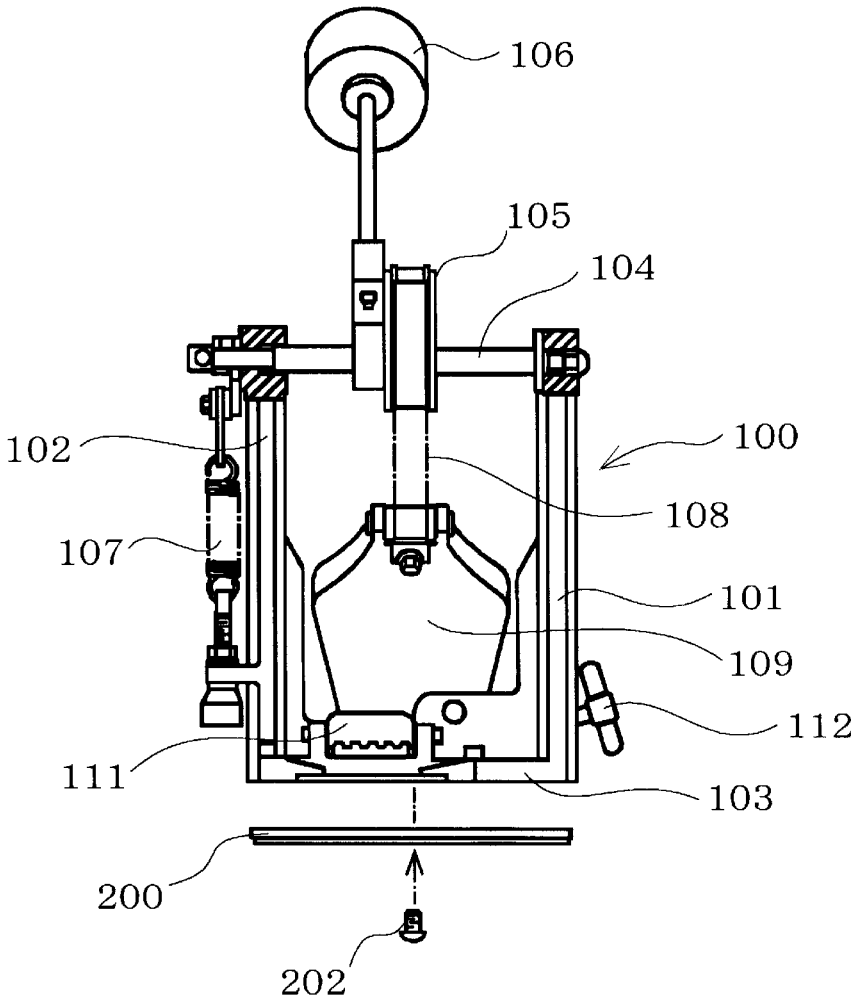
FIG. 7 (Prior Art)
FIG. 7 is a front view showing a conventional foot pedal for a drum.
Figure 8:
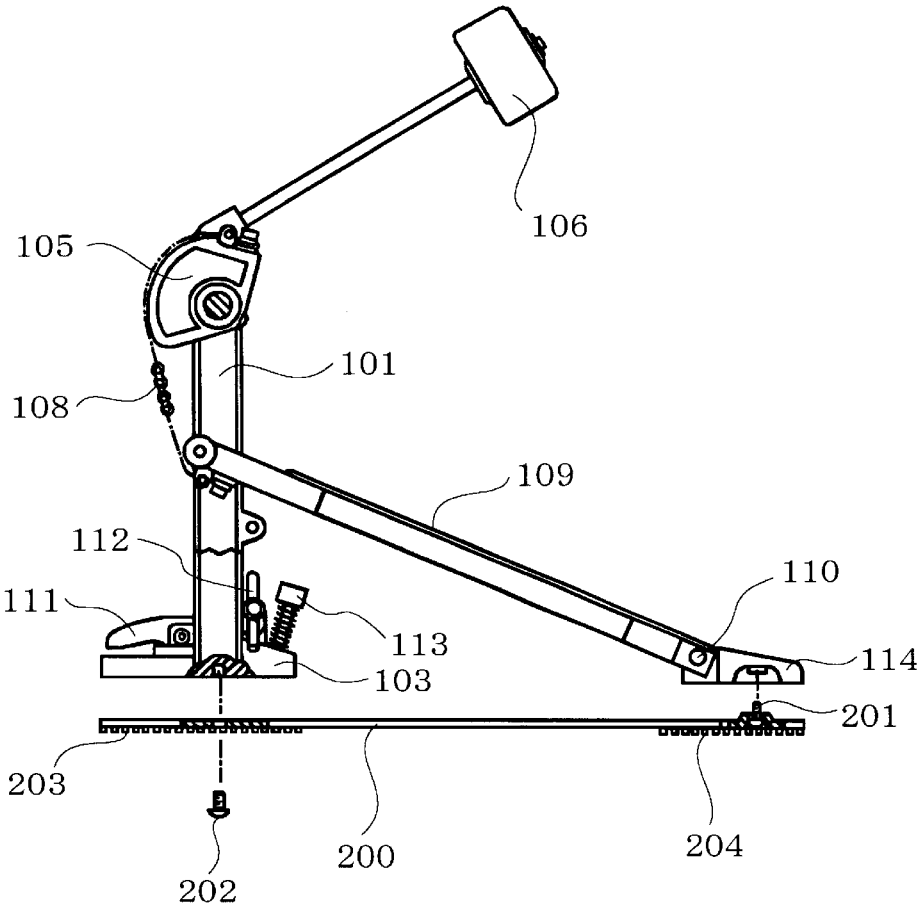
FIG. 8 (Prior Art)
FIG. 8 is a side view showing the conventional foot pedal for a drum.
Figure 9:
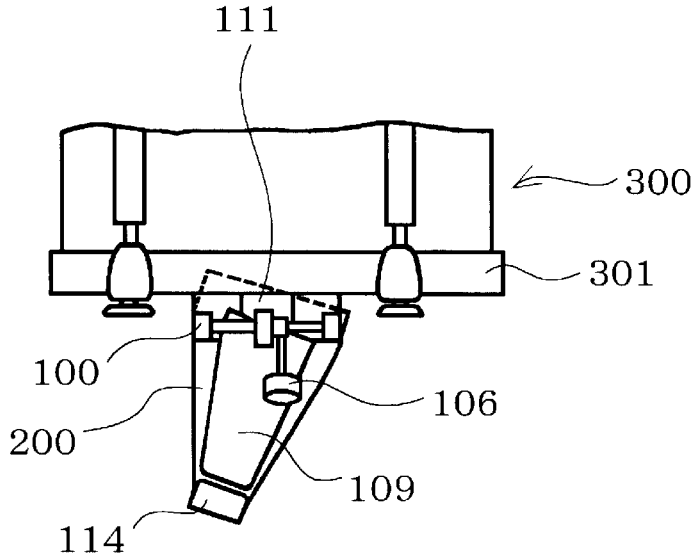
FIG. 9 (Prior Art)
FIG. 9 is an explanatory view showing a usage state of the conventional foot pedal for a drum.
Figure 10:
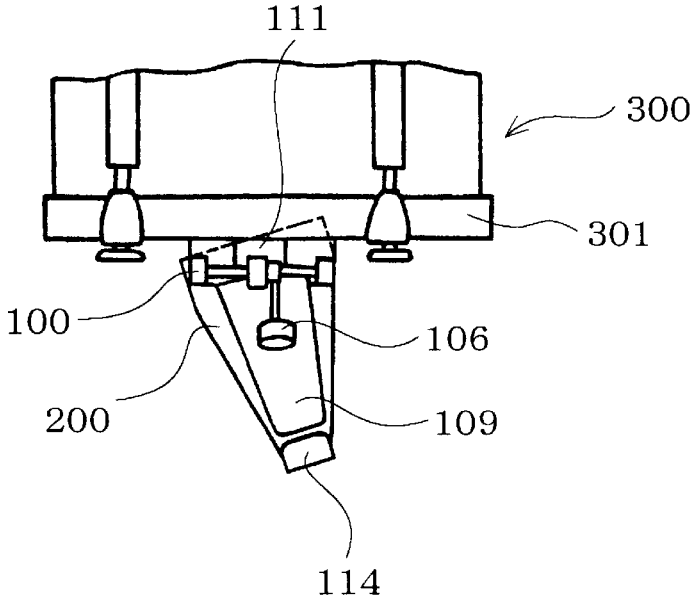
FIG. 10 (Prior Art)
FIG. 10 is an explanatory view showing a usage state of the conventional foot pedal for a drum.
Figure 11:
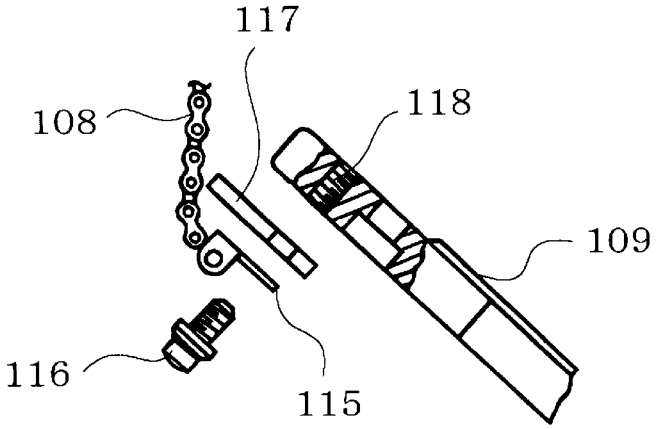
FIG. 11 (Prior Art)
FIG. 11 is an explanatory view of a distortion preventing structure of a pressing force transmitting member in the conventional foot pedal for a drum.

As shown in FIG. 6, the angle adjusting faces 52 and 53 of the angle adjusting member 49 may come in plane contact with the end face 41*a* of the pedal 41. In other words, by pivoting the pedal 41 at such an angle that the end face 41*a* completely comes in plane contact with the angle adjusting face 52 or 53, the pedal 41 can securely be positioned in a stable state.

In this connection, in FIG. 6, it is apparent that an upper limit of a crossing angle $\alpha$ of the center line of the pedal 41 to the center line of the angle adjusting member 49 is determined according to an inclination angle between the angle adjusting faces 52 and 53. For example, the crossing angle $\alpha$ is set to become 15° when the end face 41*a* of the pedal 41 is completely brought in plane contact with the angle adjusting face 52 or 53. As shown in FIG. 1, such a constitution is employed that the heel 42 reaches one end portion of the guide groove 2 or near thereto at this time.

Incidentally, even at any time at which the end face 41*a* of the pedal 41 does not completely come in plane contact with the angle adjusting face 52 or 53, it is possible to couple the pedal 41 and the angle adjusting member 49 firmly by fastening the fixing screw 56 into the nut 64 tightly, so that a player can position the pedal 41 at his/her desired angle (orientation).

Next, a procedure for fixing the foot pedal to the bass drum to position the pedal 41 will be explained.

First, the base plate 1 and the frame 5 are fixed to the bass drum by sandwiching the hoop of the bass drum between the clamp metal fitting 13 and the bottom plate 8 of the frame 5 to fasten the clamp metal fitting fastening screw 11. Also, the base plate 1 is fixed to a floor face by fastening the anchor screws 9 and 10.

Next, the pedal 41 and the heel 42 are put in a free state from each other by slightly loosening the fixing screw 56 on the distal end side of the pedal 41 and the fixing screw 47 on the heel 42 side, and the pedal 41 is set at a desired angle while being pivoted in the arrow A in FIGS. 1 and 2. The heel 42 is moved along the elongated holes 44 and 45 so that optimal positions of the heel 42 and the pedal 41 are determined on the longitudinal direction of the base plate 1. The fixing screws 56 and 57 can be fastened after the position of the pedal 41 has been determined.

With only these works, the whole foot pedal can securely be fixed to the bass drum and a player can set and fix the pedal 41 at his/her desired angle (orientation). Accordingly, for example, the foot pedal can be set such that the heel 42 is directed inwardly in a state that a drum head of a bass drum faces front (an audience side), so that a pedal position can be realized. Of course, when the foot pedal is used by the left foot of a player, the pedal 41 and the heel 42 can be pivoted in a reverse direction and fixed.

Here, it is also preferable regarding sound effect that the drum head can be set so as to face front.

Also, even if the pedal 41 has been set at an angle shown in FIG. 1 (an angle shown with a solid line in FIG. 6), since the angle adjusting member 49 faces front, it is no possibility that the pressing force transmitting member 22 is distorted.

Incidentally, by using, as the fixing screws, key bolts which are frequently used in a drum set, it is made possible to operate the fixing screws 56 and 57 by means of a drum key.

In case that an angle or a position of the pedal 41 which has been once set is finely adjusted or reset, a player may carry out such a simple working including loosening the fixing screws 56 and 57 from the above the foot pedal to adjust the angle or the like of the pedal 41 and then fastening the fixing screws 56 and 57 again. Accordingly, it is unnecessary to loosen the screws from the underside of the foot pedal or detach the foot pedal itself from the drum set like the conventional art and the angle adjustment and setting of the pedal 41 can be performed in a state that the foot pedal remains fixed to the drum set.

Further, in the present invention, since such a structure is employed that a portion of the pedal 41 which is positioned on the heel 42 side, the shape of the base plate 1 is necessarily formed in generally a fun shape or a foot fin whose portion positioned on a player's side is made wider. This structure means that a load imparted from a foot of a player can stably be supported by the wider base plate 1, and such a stability can be achieved that, even when the pedal 41 is reciprocated violently at a high speed, the foot pedal does not displace.

Incidentally, since the present invention is to provide a foot pedal where a player has fixed the pedal at an angle (orientation) desired by him/her, as shown in FIG. 1, for example, a structure where the pedal has been preliminarily fixed at a predetermined angle (orientation) so that a portion of the pedal positioned on the heel side can not be pivoted or swung will also be included in a scope of claims in view of the doctrine of equivalent.

Though unillustrated, the foot pedal of the present invention is applicable to a foot pedal with two beaters, a foot pedal structure where two foot pedals joined together are used.

Further, the detailed structure of the foot pedal illustrated does not limit the technical scope of the present invention and it is only one embodiment. Therefore the present invention can be modified or changed variously within the scope of the invention.

What is claimed is:

1. A foot pedal for a drum which beats a drum head by swinging a beater according to pressing of a pedal, comprising:

a heel which pivotally supports the pedal along a pressing direction of the pedal; and a base plate which has an arc-shaped groove allowing pivoting of the heel on a horizontal plane, wherein the pedal and the heel are pivotable integrally along the guide groove, and the heel can be fixed to the base plate at any position along the guide groove.

2. A foot pedal for a drum according to claim 1, further comprising:

a frame which is provided in a standing manner and fixed on a top face of the base plate;

a shaft which is bridged between a pair of struts of the frame and to which a beater is fixed;

a pressing force transmitting member which transmits a pressing of the pedal to the shaft to rotate the shaft and swing the beater;

an angle adjusting member which is connected to an end of the pressing force transmitting member which is positioned on a side opposed to the shaft to pivotably support the pedal at a distal end portion thereof;

a fixing screw for fixing the pedal to the angle adjusting member from the above; and another fixing screw for fixing the heel to the base plate from the above.

3. A foot pedal for a drum according to claim 2, wherein the angle adjusting member has at least one angle adjusting face which comes in plane contact with an end face of the pedal to position the pedal.

4. A foot pedal for a drum according to claim 1, wherein the heel is formed so as to be movable on the base plate in a direction generally perpendicular to the guide groove.

5. A foot pedal for a drum according to claim 2, wherein the heel is formed so as to be movable on the baseplate in a direction generally perpendicular to the guide groove.

6. A foot pedal for a drum according to claim 3, wherein the heel is formed so as to be movable on the base plate in a direction generally perpendicular to the guide groove.

* * * * *